United States Patent [19]

Laveran

[11] Patent Number: 4,911,236

[45] Date of Patent: Mar. 27, 1990

[54] TUBE AND FIN AIR CONDITIONING EVAPORATOR WITH PLATE COIL SUCTION MANIFOLD

[75] Inventor: Jean-Louis Laveran, Asnières, France

[73] Assignee: Valeo, Paris, France

[21] Appl. No.: 327,010

[22] Filed: Mar. 22, 1989

[30] Foreign Application Priority Data

Mar. 22, 1988 [FR] France ..... 88 03698

[51] Int. Cl.[4] ..... F25B 39/02

[52] U.S. Cl. ..... 165/175; 62/515

[58] Field of Search ..... 165/173, 174, 175; 137/561 A, 602; 62/515

[56] References Cited

U.S. PATENT DOCUMENTS

| | | | |
|---|---|---|---|
| 1,985,617 | 12/1934 | Morton . | |
| 2,088,254 | 7/1937 | Wolfert . | |
| 4,244,194 | 1/1981 | Haesters | 165/173 X |
| 4,430,868 | 2/1984 | Kern . | |

FOREIGN PATENT DOCUMENTS

| | | |
|---|---|---|
| 1213670 | 3/1966 | Fed. Rep. of Germany . |
| 1015443 | 9/1952 | France . |
| 1035169 | 8/1953 | France . |
| 2509447 | 1/1983 | France . |
| 2058917 | 4/1981 | United Kingdom . |

*Primary Examiner*—Alan Cohan

*Attorney, Agent, or Firm*—Dennison, Meserole, Pollack & Scheiner

[57] ABSTRACT

The present invention provides a heat exchanger for changing the state of a fluid, particularly an evaporator for an air conditioning installation, comprising finned tubular circuits, a fluid distributor device for distributing fluid to the inlets of the tubular circuits through appropriate tubes, and a fluid collector device connecting the outlets of the tubular circuits to an exhaust tube through connecting tubes. The outlets of the tubular circuits are connected to the exhaust tube through a single manifold member formed from two plates superimposed upon each other, with at least one of these plates having projecting portions on one of its faces forming hollow conduits and passages. The invention is particularly applicable to automotive vehicles.

8 Claims, 1 Drawing Sheet

TUBE AND FIN AIR CONDITIONING EVAPORATOR WITH PLATE COIL SUCTION MANIFOLD

FIELD OF THE INVENTION

The present invention relates to a heat exchanger for changing the state of a fluid, for example an evaporator for an air conditioning installation, especially for an automotive vehicle.

BACKGROUND OF THE INVENTION

An evaporator or a condenser usually includes a multiplicity of tubular circuits, comprising a succession of parallel U tubes, connected with each other by means of curved tube sections in such a way as to form, for each tubular circuit, a serpentine path, with fins through which the tubes extend. These fins are substantially perpendicular to the tubes and are in heat conducting contact with the latter. The evaporator or condenser further typically includes a distributor device for the fluid, which is for example a refrigerant fluid of the Freon type, this distributor device being connected to one end of the said circuits and to a feed tube for the fluid; it also includes a fluid collector device which is connected to the other end of the tubular circuits and to an exhaust tube for the fluid.

In addition, in an evaporator of this kind, the tubular circuits are arranged in such a way that the segments of the parallel U tubes forming part of the circuits are grouped so that the said segments are either juxtaposed with each other or superimposed on each other.

This arrangement is necessary in order to ensure a change of state of the refrigerant fluid in the tubular circuits so that the fluid, after undergoing heat exchange with another fluid (for example ambient air passing through the evaporator) will always be in the required second state by the time it reaches the outlets of the tubular circuits.

To this end, the fluid distributor device conventionally includes thin or capillary tubes which are connected to the inlets of the tubular circuits and to the feed tube, in such a way that the fluid is substantially evenly distributed between the circuits.

The collector device allows the exhaust tube and the outlets or the tubular circuits to be connected together through connecting tubes which are sealingly fixed to the collector and to the said outlets.

Such a collector device is formed from the free ends of the tubes constituting the circuits, by flattening and enlarging each of these free ends into general shape of a flat nozzle, having a mouth larger in the radial direction than the tube itself.

The flat nozzle thus formed has two parallel walls connected at their ends through semi-cylindrical walls, and is adapted to receive the ends of the connecting tubes. Its dimensions are so chosen that, firstly, the distance between the parallel walls is substantially equal to the diameter of a connecting tube, and secondly, the distance between the two semi-cylindrical walls is substantially equal to the sum of the diameters of those connecting tubes which are located within the nozzle. The connecting tubes are disposed side by side in the nozzle, so as to lie in a common plane and to extend in a common direction.

Once the ends of the connecting tubes have been placed in the mouth of the flat nozzle, they are secured to it in a fixed and sealed manner, for example by brazing.

It has however been established that the arrangement described above has certain disadvantages. In order to obtain the flat nozzle shape, it is necessary to carry out a lengthy and costly forming operation on the free end of the tube of each tubular circuit. Even then, the number of connecting tubes which can be received within such a nozzle is not as large as may be desirable, since the dimensions of the nozzle depend on those of the free end of the circuit tube. In addition, in order to connect the ends of the connecting tubes within the nozzle, the brazing operation entails a danger of introducing braze metal into undesirable places, for example into the mouths of the connecting tubes connected to the tubular circuits. This adversely affects satisfactory operation of the tubular circuits, even to the extend of the entry to the connecting tubes becoming totally obstructed, and consequently the outlet of a tubular circuit being similarly obstructed.

SUMMARY OF THE INVENTION

An object of the present invention is to overcome the above mentioned disadvantages. To this end, the invention proposes an evaporator having a fluid collector device of simple construction, economical to produce and leading to reliable operation of the evaporator.

According to the invention, there is provided a heat exchanger for changing the state of a fluid, for example an evaporator for an air conditioning installation, for example for an automotive vehicle, wherein the heat exchanger comprises a plurality of tubular circuits, a plurality of fins associated with said tubular circuits, a fluid distributor device, for the fluid in a first state thereof, each tubular circuit having inlet means and outlet means, the said fluid distributor device comprising a plurality of tubes connecting the said inlet means with a feed tube, and the heat exchanger further comprising a collector for the fluid after its state has been changed to a second state, the collector comprising an exhaust tube and a plurality of connecting tubes, with each said connecting tube connecting the outlet means of a respective said tubular circuit with the exhaust tube, the heat exchanger being further provided with a single manifold member connecting the outlet means of the tubular circuits with the exhaust tube, the manifold member comprising two plates superimposed on each other, with at least one of the said plates having on one to its faces projecting portions constituting hollow conduits and passages.

This structure is such that the said plates and hollow conduits and passages can be given any convenient shape, while any number of passages and conduits is possible.

The other features and advantages of the invention will appear more clearly from the description which follows, and which is given with reference to the accompanying drawings.

DESCRIPTION OF A PREFERRED EMBODIMENT

Figure 1:
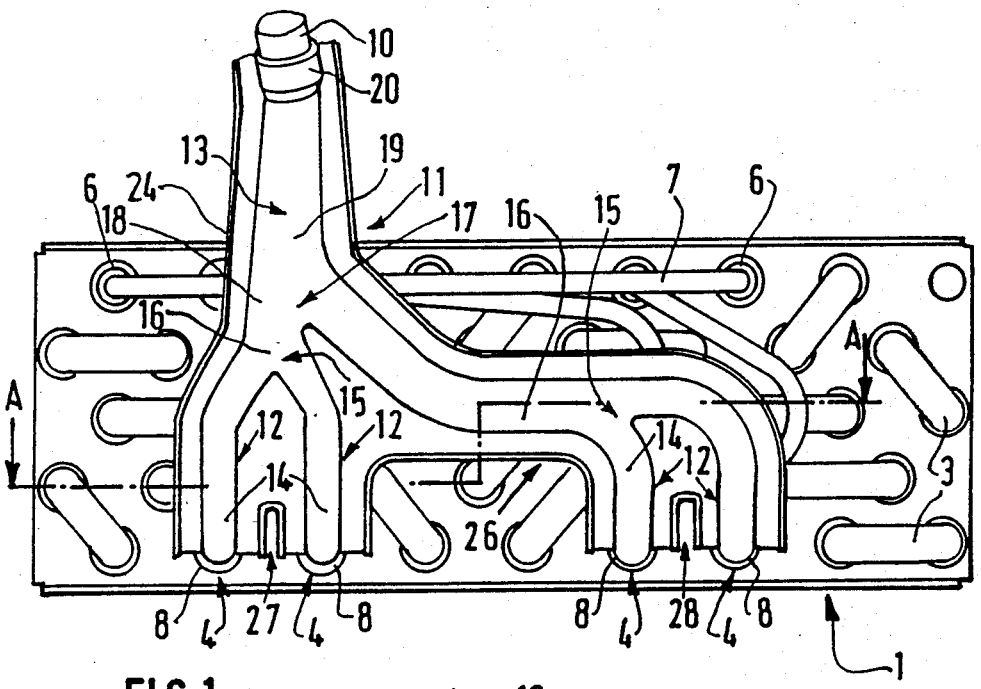
FIG. 1 is a view in elevation showing a heat exchanger according to the invention.
Figure 2:
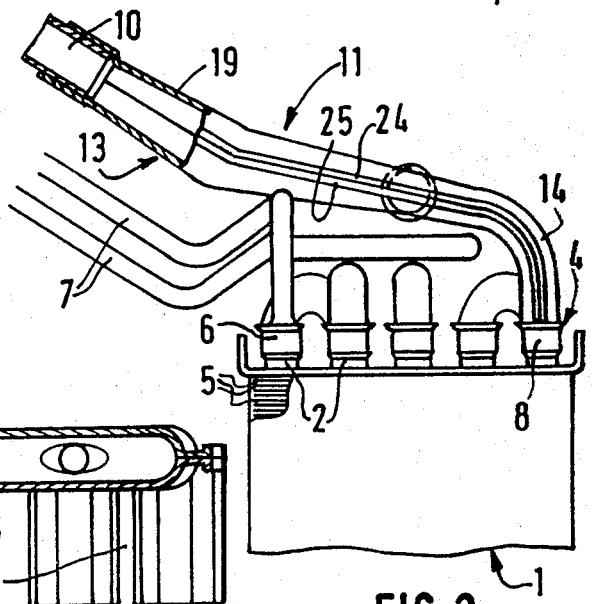
FIG. 2 is a side view of the heat exchanger shown in FIG. 1.

Reference is first made to FIGS. 1 and 2. In these Figures, the heat exchanger 1, which in this example is an evaporator for changing the state of a refrigerant fluid such as a Freon passing through it, comprises a succession of U tubes 2 which are parallel to each other. The U tubes 2 are joined together by means of curved tube sections 3, in such a way as to form a serpentine tubular circuit 4. The evaporator 1 also has fins 5, through which, in this example, at least two of the tubular circuits 4 extend. In FIGS. 1 and 2 there are four such circuits 4. The fins 5 are substantially perpendicular to the heat exchanger tubes and are in heat conducting with them. In an alternative arrangement, the fins 5 may be arranged so as to be longitudinal with respect to the tubes, being joined sealingly to the latter. Each of the circuits 4 has an inlet end 6 for admission of the refrigerant fluid in its initial state. This admission is effected through a distributor device, not fully shown in the drawings, comprising a feed tube together with narrow or capillary tubes 7 which are connected to the inlets 6. Each circuit 4 also has an outlet end 8 for evacuation of the fluid from the heat exchanger, via an exhaust tube 10, after its state has been changed.

As can be seen from the drawings, the outlets 8 of the circuits 4 are connected to the exhaust tube 10 through a single manifold member 11 comprising a plurality of connecting tube 12 and a collector 13.

The manifold 11 comprises two plates 24 and 25 superimposed on each other. At least one of the plates 24 and 25 has a plurality of projecting portions on one of its faces. Each of these projecting portions of one of the plates 24 or 25, when covered by the other plate 25 or 24, forms a hollow passage constituting a respective one of the connecting tubes 12 and the collector 13.

In this example, each plate 24 or 25 is such that, after the plates have been superimposed on each other, these projecting portions form substantially cylindrical conduits and passages.

In this way (by way of example) at least two hollow conduits 14 are provided, extending from one side of the manifold member 11 and constituting the connecting tubes 12. Here there are four of these conduits, which are in communication with the outlets 8 of the circuits 4 and are joined to each other in pairs at respective first intersections 15, each defining a hollow first passage 16. Each of these first passages 16 in turn is joined in a second intersection 17, defining a second hollow passage 18 which communicates with a third hollow passage 19 constituting the collector 13 itself. The third hollow passage 19 is secured sealingly to the exhaust tube 10.

Figure 3:
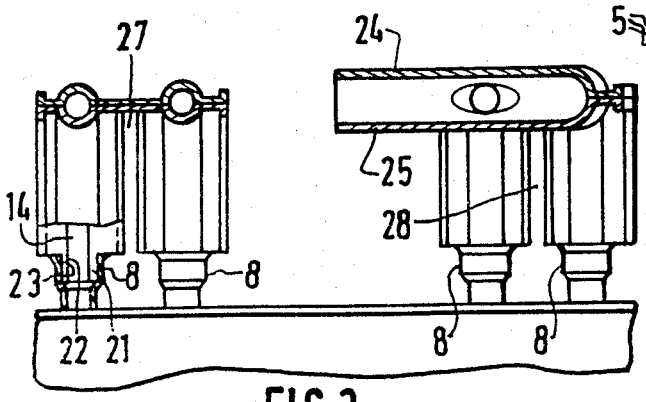
FIG. 3 is a view taken in cross section on the line A—A in FIG. 1.

Referring now to FIG. 3, the hollow conduits 14 are connected with the outlets 8 of the circuits 4 by means of end portions 21 of the conduits 14, which project beyond the bottom edges of the conduits proper. Each end portion 21 comprises a portion of the plates 24 and 25 so shaped as to form a hollow cylindrical tube portion 22 which fits within the opening 23 formed in the corresponding outlet 8, in such a way as to permit it to be secured an a sealing manner.

As can be seen from the drawings, the bottom edge of each conduit also serves as an abutment which limits the amount by which the tube portion 22 extends into the opening 23, by virtue of the contact between the said edge and the free end of the opening 23. It also allows the manifold 11 to be correctly positioned with respect to the outlets 8.

With the exception of the hollow conduits 14 and passages 16 and 19, the two plates 24 and 25 are connected to each other in a fixed and sealing manner through their mutual contact surfaces, for example by adhesion or brazing, at the same time as the third hollow passage 19 and the passage end portions 21 are connected respectively to the exhaust tube 10 and to the outlets 8.

The plates 24 and 25 are preferably provided with openings 26, 27 and 28 in the region of their end portions 21, in order to reduce the area of the surface which it is necessary to secure to each other.

FIG. 2 shows that the manifold member 11 is bent along its mating surfaces, in a direction substantially orthogonal to that of the outlets 8, so as to reduce the overall height of the manifold.

The present invention is of course not limited to the embodiment described, but embraces all variations thereof. For example, the plates 24 and 25 may be formed from a signal plate which includes the various projecting portions and which can be folded substantially along its median line like a book, so that the two plates are then brought together and secured in a fixed and sealing manner.

Similarly, the manifold member 11 may be a single member comprising a plate which includes, within it and parallel to its faces, hollow passages which may be formed by expansion using any suitable known method, such as that known as the "roll bond" method.

What is claimed is:

1. A heat exchanger for changing the state of a fluid, for example an evaporator for an air conditioning installation, for example for an automotive vehicle, wherein the heat exchanger comprises a plurality of tubular circuits, a plurality of fins associated with said tubular circuits, a fluid distributor device, for the fluid in a first state thereof, each tubular circuit having inlet means and outlet means, the said fluid distributor device comprising a plurality of tubes connecting the said inlet means with a feed tube, and the heat exchanger further comprising a collector for the fluid after its state has been changed to a second state, the collector comprising an exhaust tube and a plurality of connecting tubes, with each said connecting tubular circuit with the exhaust tube, the heat exchanger being characterised by a single manifold member connecting the outlet means of the tubular circuits with the exhaust tube, the manifold member comprising two plates superimposed on each other, with at least one of the said plates having on one of its faces projecting portions constituting hollow conduits and passages.

2. A heat exchanger according to claim 1, characterised in that the said hollow conduits constitute the said connecting tubes.

3. A heat exchanger according to claim 1, characterised in that at least two said hollow conduits define a first intersection joining the said conduits together.

4. A heat exchanger according to claim 1, characterised by at least two first hollow passages defining a second intersection and a second hollow passage leading from the second intersection.

5. A heat exchanger according to claim 4, characterised in that the second hollow passage leads into the collector.

6. A heat exchanger according to claim 5, characterised in that the collector comprises a third hollow passage connected to the exhaust tube.

7. A heat exchanger according to claim 1, characterised in that the said plates are secured to each other in a fixed and sealed manner.

8. A heat exchanger according to claim 1, characterised in that the manifold member is provided with openings sealed around the edges.

* * * * *